US011930866B2

(12) United States Patent
Fosse et al.

(10) Patent No.: US 11,930,866 B2
(45) Date of Patent: Mar. 19, 2024

(54) FACE SHIELD

(71) Applicant: Innovative Packaging, Inc., Cambridge, MN (US)

(72) Inventors: Jonathon Fosse, Cambridge, MN (US); Andrew Fosse, Cambridge, MN (US)

(73) Assignee: Innovative Packaging, Inc., Cambridge, MN (US)

( * ) Notice: Subject to any disclaimer, the term of this patent is extended or adjusted under 35 U.S.C. 154(b) by 0 days.

(21) Appl. No.: 17/381,935

(22) Filed: Jul. 21, 2021

(65) Prior Publication Data

US 2022/0022574 A1 Jan. 27, 2022

Related U.S. Application Data

(60) Provisional application No. 63/054,565, filed on Jul. 21, 2020.

(51) Int. Cl.
*A41D 13/11* (2006.01)

(52) U.S. Cl.
CPC ..... *A41D 13/1161* (2013.01); *A41D 13/1184* (2013.01)

(58) Field of Classification Search
CPC ..... A41D 13/1161; A41D 13/1184; A41D 13/11; A41D 13/1218; A42B 3/20; A42B 3/225; A42B 3/18; A42B 3/22; A61F 9/04–06
USPC ..... 2/9
See application file for complete search history.

(56) References Cited

U.S. PATENT DOCUMENTS 3,103,667 A 9/1963 Rogowski
4,856,535 A 8/1989 Forbes
4,920,576 A * 5/1990 Landis ..... A41D 13/1184 2/9
4,964,171 A 10/1990 Landis

FOREIGN PATENT DOCUMENTS

AT 16787 U2 * 3/2020
DE 202020102824 U1 * 7/2020

OTHER PUBLICATIONS

Translation of AT-16787-U2 (Year: 2020).*
Translation of DE-202020102824-U1 (Year: 2020).*
Fey Industries, Inc. "Preserve-A-Mask Face Shield," 1 page.
Martinez, Andrew, "UMass Amherst designs face shield for fight against coronavirus surge," Boston Herald, Apr. 6, 2020, https://www.bostonherald.com/2020/04/06/umass-amherst-designs-face-shield-for-fight-against-coronavirus-surge/, 3 pages.
NPL Video Citation No. 0001, Titled "Preserve-A-Mask™ Face Shields | Medical PPE," published by Fey Industries on Mar. 31, 2020, retrieved at https://www.youtube.com/watch?v =-BMNE1UFQhQ, select screenshots included, 5 pages.

* cited by examiner

*Primary Examiner* — Keri J Nelson
*Assistant Examiner* — Seth R. Brown
(74) *Attorney, Agent, or Firm* — Kinney & Lange, P.A.

(57) ABSTRACT

A face shield includes a front surface opposite of a back surface, a shield portion, and a band portion extending from a top side of the shield portion. A plurality of spacing projections extend outward from the back surface of the face shield that are configured to be positioned against a forehead of a wearer.

19 Claims, 12 Drawing Sheets

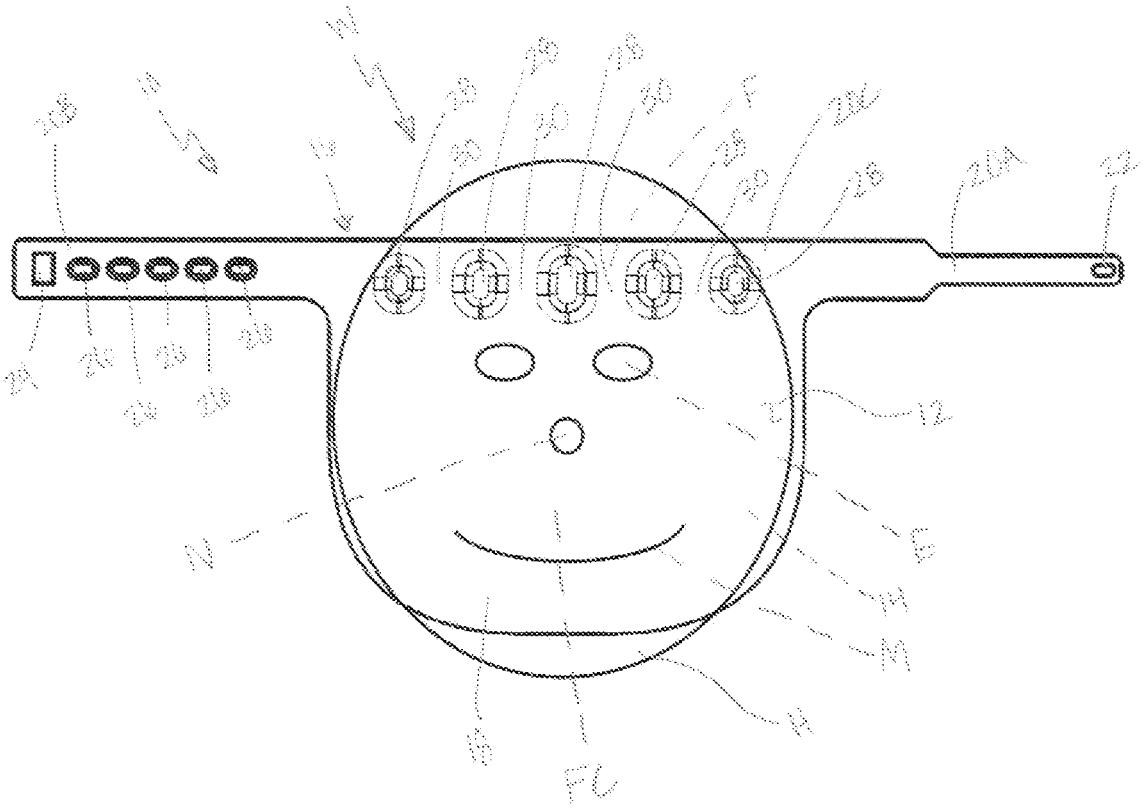
W
10
18
20
20
20

FACE SHIELD

CROSS-REFERENCE TO RELATED APPLICATION(S)

This application claims priority to U.S. Provisional Application No. 63/054,565, filed on Jul. 21, 2020, and entitled "Face Shield," the disclosure of which is incorporated by reference in its entirety.

BACKGROUND

The present disclosure relates to personal protective equipment, and in particular, to a face shield.

Personal protective equipment includes garments that can be worn to protect the wearer. For example, personal protective equipment can include clothing, helmets, face masks, face shields, goggles, etc. Personal protective equipment can be worn to protect the wearer from exposure to physical, electrical, chemical, or biological hazards.

Face shields, in particular, can be worn to protect the wearer from exposure to physical hazards such as flying particles, chemical hazards such as gas fumes, or biological hazards such as airborne particles. Face shields, however, can be uncomfortable to wear for extended periods of time. Traditionally, face shields can be flat, plastic pieces that sit against a wearer's face, which can be uncomfortable and interfere with glasses. Face shields can also have a foam piece positioned on a top side of the face shield to rest against a wearer's forehead. The foam piece can improve comfort, but can limit venting between the face shield and the wearer's face and cause the face shield to fog due to the wearer's breaths. Adding foam pieces to face shields also requires additional materials and manufacturing steps, increasing the cost and time needed to produce the face shields.

SUMMARY

A face shield includes a front surface opposite of a back surface, a shield portion, and a band portion extending from a top side of the shield portion. A plurality of spacing projections extend outward from the back surface of the face shield that are configured to be positioned against a forehead of a wearer.

BRIEF DESCRIPTION OF THE DRAWINGS

FIG. 1C is a front plan view of the first embodiment of the face shield shown in FIG. 1A positioned over a wearer.

DETAILED DESCRIPTION

Figure 1A:
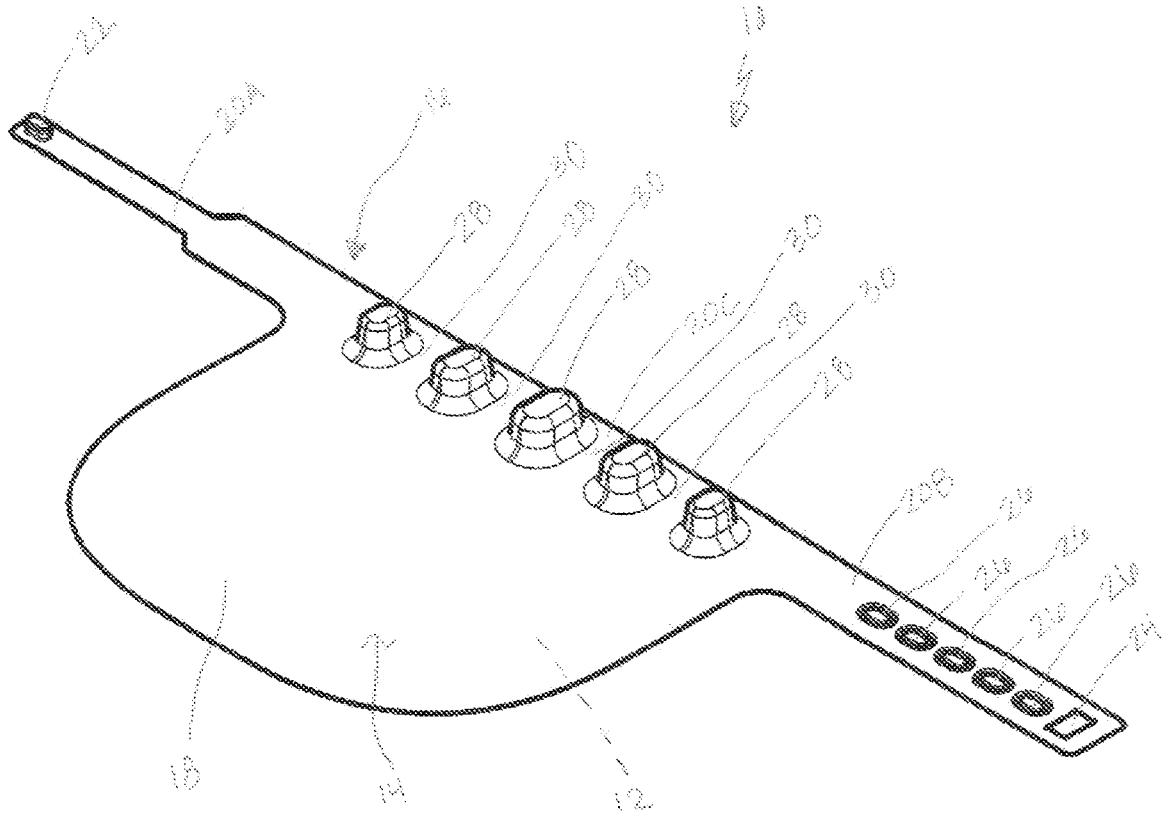
FIG. 1A is back isometric view of a first embodiment of a face shield.
Figure 1B:
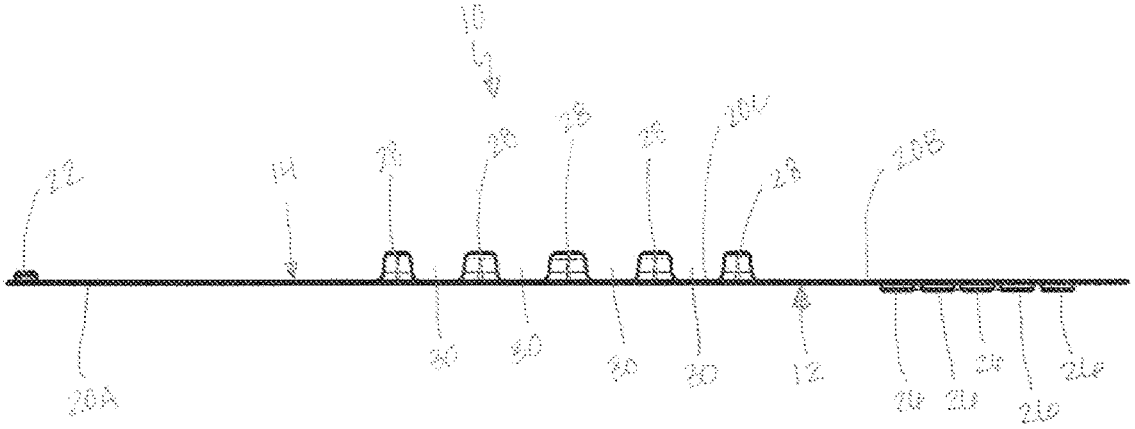
FIG. 1B is a side view of the first embodiment of the face shield shown in FIG. 1A.

FIG. 1A is back isometric view of face shield 10. FIG. 1B is a side view of face shield 10. FIG. 1C is a front plan view of face shield 10 positioned over wearer W. FIGS. 1A-1C will be discussed together. Face shield 10 includes front surface 12, back surface 14, band portion 16, and shield portion 18. Band portion 16 includes first arm 20A, second arm 20B, and center portion 20C. First arm 20A includes snap stud 22. Second arm 20B includes keeper 24 and snap sockets 26. Center portion 20C includes spacing projections 28 and ventilating spaces 30. Face shield 10 is shown as being transparent in FIG. 1C, which further shows wearer W having head H, forehead F, face FC, eyes E, nose N, and mouth M.

Face shield 10 includes front surface 12 and back surface 14. Front surface 12 is a first surface of face shield 10 that will face outward from wearer W when face shield 10 is being worn. Back surface 14 is a second surface of face shield 10 opposite front surface 12 that will face towards wearer W when face shield 10 is being worn. Band portion 16 is a top portion of face shield 10. Shield portion 18 is a lower portion of face shield 10 with a top side contiguous with band portion 16. Band portion 16 is wider than shield portion 18 and extends beyond a first side and a second side of shield portion 18.

Band portion 16 includes first arm 20A, second arm 20B, and center portion 20C. First arm 20A extends beyond a first side of shield portion 18. Second arm 20B extends beyond a second side of shield portion 18 opposite first arm 20A. Center portion 20C is between first arm 20A and second arm 20B and extends from a top side of shield portion 18. Band portion 16, including first arm 20A, second arm 20B, and center portion 20C, and shield portion 18 are integrally formed out of a single material.

First arm 20A includes snap stud 22, which is a protrusion that protrudes outwards from back surface 14. Snap stud 22 is positioned near an outer end of first arm 20A. Second arm 20B includes keeper 24 that is a rectangular cut that is sized to be slightly larger than a width of first arm 20A. First arm 20A has an end portion that is slightly narrower than second arm 20B that is configured to be positioned in keeper 24.

Keeper 24 is positioned near an outer end of second arm 20B. Second arm 20B also has snap sockets 26 positioned between keeper 24 and center portion 20C. Snap sockets 26 are hollow protrusions that protrude outwards from front surface 12 of second arm 20B. Snap sockets 26 are sized slightly larger than snap stud 22. Snap stud 22 is configured to be releasably engaged in any one of snap sockets 26.

Center portion 20C of band portion 16 includes spacing projections 28 that protrude outwards from back surface 14. Spacing projections 28 are separated from one another by ventilating spaces 30. One ventilating space 30 is positioned between adjacent spacing projections 28. In the embodiment shown in FIGS. 1A-1C, face shield 10 includes five spacing projections 28 and four ventilating spaces 30. In alternate embodiments face shield 10 can include any suitable number of spacing projections 28 and ventilating projections 30. In further alternate embodiments, spacing projections 28 and ventilating spaces 30 can be positioned on shield portion 18.

Face shield 10 is configured to be worn by wearer W. When worn by wearer W, face shield 10 is oriented so that front surface 12 is away from wearer W and back surface 14 is toward wearer W. FIG. 1C shows the placement of face shield 10 over head H of wearer W. As shown in FIG. 1C, center portion 20C of band portion 16 is configured to be positioned against forehead F of wearer W, and shield portion 18 is configured to be positioned over and eyes E, nose N, and mouth M of wearer W. Once face shield 10 is positioned over head H of wearer W, band portion 16 can be curled to create a headband that fits around head H of wearer W. First arm 20A fits through keeper 24 on second arm 20B. Thus, band portion 16 is looped to form a headband. Band portion 16 is secured by fitting snap stud 22 into one of plurality of snap sockets 26. Band portion 16 can be specifically sized for wearer W by selecting one of plurality of snap sockets 26. Alternatively, band portion 16 can be looped and secured by fitting snap stud 22 into one of plurality of snap sockets 26 before face shield 10 is positioned on wearer W. The looped band portion 16 can then be placed on head H of wearer W. Spacing projections 28 rest against forehead F to hold face shield 18 away from eyes E, nose N, and mouth M of wearer W. Ventilating spaces 30 allow air flow from above and below head H of wearer W to flow between face FC and back surface 14 of face shield 10. Shield portion 18 creates a barrier between face FC, and specifically eyes E, nose N, and mouth M of wearer W, and the environment in front of wearer W.

Face shield 10 is a single-piece product ready to be used by wearer W and does not need to be assembled by wearer W. Face shield 10 is designed to be made from a single piece of material. Face shield 10 can be die cut and thermoformed from a single sheet of plastic material, such as polyethylene terephthalate (PET) or similar. The sheet of plastic material can be created from post-consumer recycled material. Similarly, the plastic sheet can be a recyclable material so that face shield 10 can be recycled after use. Using a recycled material in combination or alternative with a recyclable material decreases the negative environmental impact of making and using face shield 10. Further, the plastic material can be easily cleaned and sanitized to allow for safe reuse of face shield 10.

Creating face shield 10 from a single piece of die cut and thermoformed material simplifies production and use of face shield 10. Producing face shield 10 from a single material allows for quick and efficient production by eliminating additional materials, pieces, and assembly steps. Production of face shield 10 from a single material also allows for creation of a finished product ready to be used by wearer W. This eliminates the need for wearer W to assemble face shield 10, creating a simple single-product wearer W can quickly use.

Closing face shield 10 with snap stud 22 and one of snap sockets 26 is a fast, simple, and secure closure for wearer W. When snap stud 22 is engaged in one of snap sockets 26, there will be an audible noise to indicate to wearer W that band portion 16 has been secured around head H of wearer W. Creating face shield 10 with a plurality of snap sockets 26 allows for wearer W to customize the size of face shield 10 for an individualized fit. Snap stud 22 and snap sockets 26 also fit together firmly so face shield 10 is securely closed in the looped headband shape. Further, keeper 24 holds first arm 20A at an angle relative to second arm 20B that lowers the force that would pull snap stud 22 out of snap socket 26. Keeper 24 allows for snap stud 22 to be securely held in one of snap sockets 26.

Figure 2A:
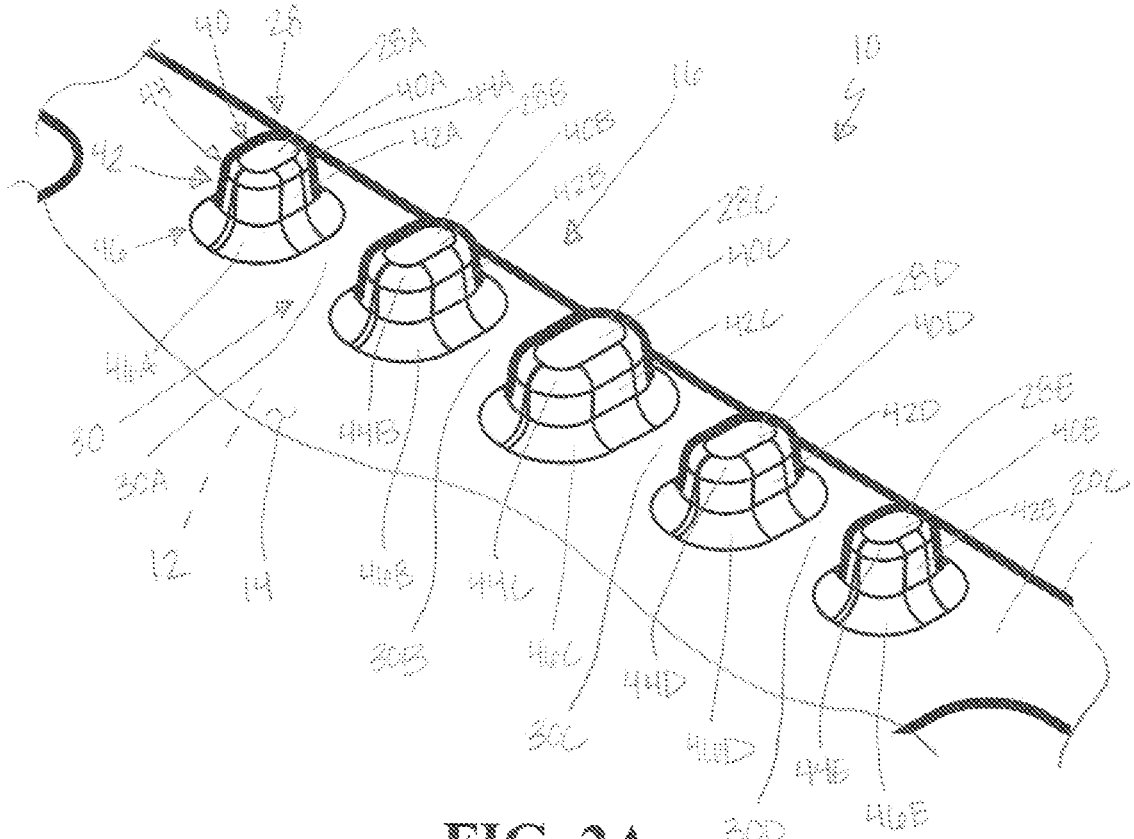
FIG. 2A is a back isometric view of spacing projections on the first embodiment of the face shield shown in FIG. 1A.
Figure 2B:
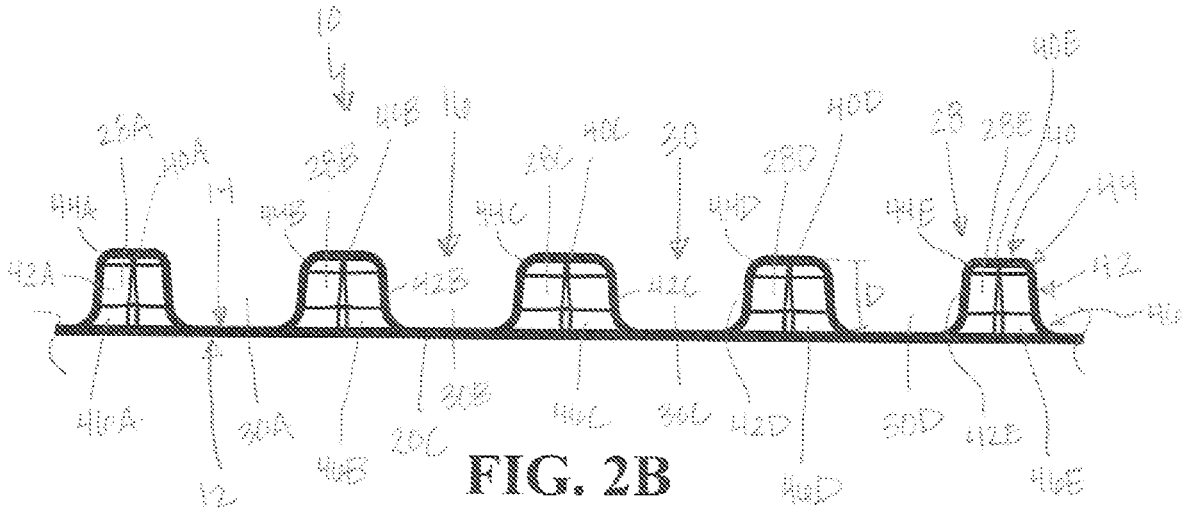
FIG. 2B is a side view of the spacing projections on the first embodiment of the face shield shown in FIG. 1A.

FIG. 2A is a back isometric view of spacing projections 28 on face shield 10. FIG. 2B is a side view of spacing projections 28 on face shield 10. FIGS. 2A-2B will be discussed together. Face shield 10 includes front surface 12, back surface 14, and band portion 16. Band portion 16 includes center portion 20C, which includes spacing projections 28 (including spacing projections 28A-28E) and ventilating spaces 30 (including ventilating spaces 30A-30D). Spacing projections 28 include contact portions 40 (including contact portions 40A-40E), sidewalls 42 (including sidewalls 42A-42E), first tapered portions 44 (including first tapered portions 44A-44E), and second tapered portions 46 (including second tapered portions 46A-46E). FIG. 2B also shows depth D.

Face shield 10 has the structure and design as described above in reference to FIGS. 1A-1C. FIGS. 2A-2B show close-up views of spacing projections 28 and ventilating spaces 30. Spacing projections 28 includes five spacing projection 28A-28E in the embodiment shown in FIGS. 2A-2B. Spacing projection 28A is positioned between a first side of center portion 20C and spacing projection 28B; spacing projection 28B is positioned between spacing projection 28A and spacing projection 28C; spacing projection 28C is positioned between spacing projection 28B and spacing projection 28D; spacing projection 28D is positioned between spacing projection 28C and spacing projection 28E; and spacing projection 28E is positioned between spacing projection 28D and a second side of center portion 20C. Ventilating spaces 30 includes four ventilating spaces 30A-30D in the embodiment shown in FIGS. 2A-2B. Ventilating space 30A is formed between spacing projection 28A and spacing projection 28B; ventilating space 30B is formed between spacing projection 28B and spacing projection 28C; ventilating space 30C is formed between spacing projection 28C and spacing projection 28D; and ventilating space 30D is formed between spacing projection 28D and spacing projection 28E.

Spacing protrusions 28 vary in size. Spacing protrusion 28C in the center of center portion 20C is the largest; spacing protrusion 28A and spacing protrusion 28E on the sides of center portion 20C are the smallest; and spacing protrusion 28B and spacing protrusion 28D are smaller than spacing protrusion 28C and larger than spacing protrusion 28A and spacing protrusion 28E. Spacing protrusions 28 vary in size to fit comfortably on the wearer's forehead.

Spacing projections 28 hold shield portion 18 (shown in FIGS. 1A-1C) of face shield 10 away from the wearer's face and create a space between the wearer's face and face shield 10. The space between the wearer's face and face shield 10 allows for face shield 10 to be worn comfortably without shield portion 18 touching the wearer's face. The space also allows for other personal protective equipment (PPE) to be worn comfortably on the wearer's face under face shield 10. PPE could include a face mask or covering over the nose or mouth, prescription glasses, or protective eyewear. Spacing protrusions 28 extend out from center portion 20C by depth D. Depth D represents the distance away from a wearer's head, and specifically a wearer's face, that shield portion 18 will sit. The size and depth D of spacing projections 28 are configured to provide a distance from the front area of the wearer's head for glasses, goggles, or masks, while also allowing band portion 16 to be closer to the side of the wearer's head.

Spacing projections 28 are oval shaped in the embodiment shown in FIGS. 1A-2B to evenly distribute material during protrusion and to provide even and consistent contact points when face shield 10 is worn by a wearer. In alternate embodiments, spacing projections 28 can be any suitable shape. Spacing protrusions 28 include contact portions 40, sidewalls 42, first tapered portions 44, and second tapered portions 46. Specifically, spacing protrusion 28A-28E include contact portions 40A-40E, sidewalls 42A-42E, first tapered portions 44A-44E, and second tapered portions 46A-46E, respectively. Contact portions 40A-40E are flat surfaces positioned away from and parallel with center portion 20C. Contact portions 40A-40E are configured to rest against a wearer's forehead when face shield 10 is being worn. Sidewalls 42A-42E are radial walls that are perpendicular to center portion 20C. First tapered portions 44A-44E extend between and connect contact portions 40A-40E to sidewalls 42A-42E, respectively. Second tapered portions 46A-46E extend between and connect sidewalls 42A-42E to center portion 20C, respectively. First tapered portions 44A-44E and second tapered portions 46A-46E allow for consistent material distribution and add strength to the location where each spacing protrusion 28 is formed. Further, first tapered portions 44A-44E at the top of each spacing protrusion 28 provide comfort to the wearer who is wearing face shield 10, as there are no sharp edges abutting the wearer's forehead.

Spacing projections 28 are spaced apart from one another to create ventilating spaces 30 between adjacent spacing projections 28 even when face shield 10 is being worn by a wearer. Ventilating spaces 30 allow air to flow from above or below face shield 10. This air flow cools the wearer's face and carries away any condensation trapped between face shield 10 and the wearer's face. Ventilating spaces 30 therefore reduce the amount of fogging created by the condensation from the wearer's breath when using face shield 10.

Figure 3A:
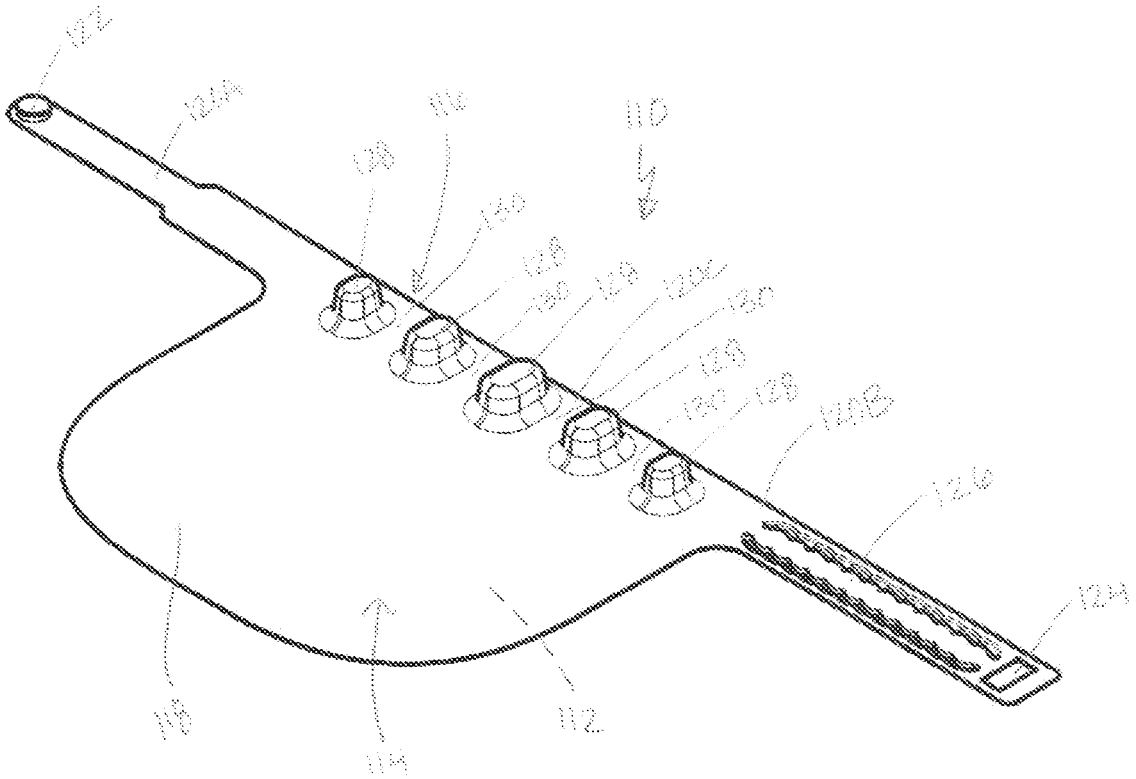
FIG. 3A is a back isometric view of a second embodiment of a face shield.
Figure 3B:
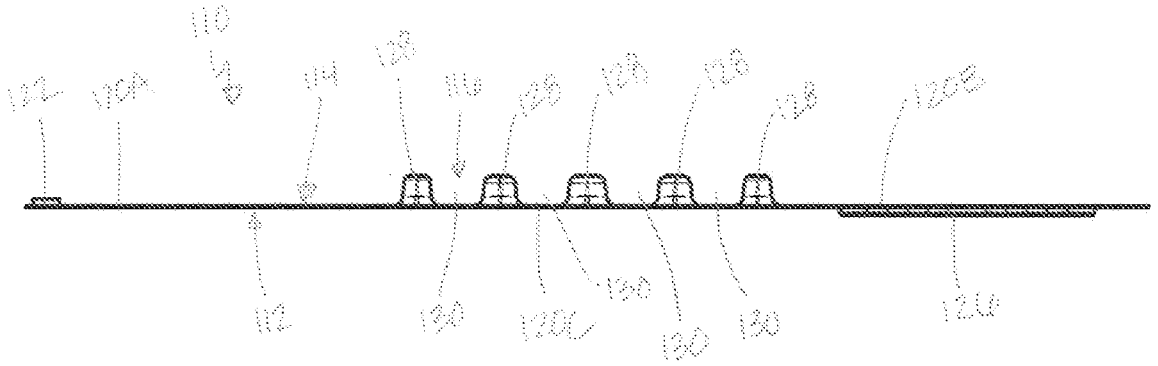
FIG. 3B is a side view of the second embodiment of the face shield shown in FIG. 3A.
Figure 3C:
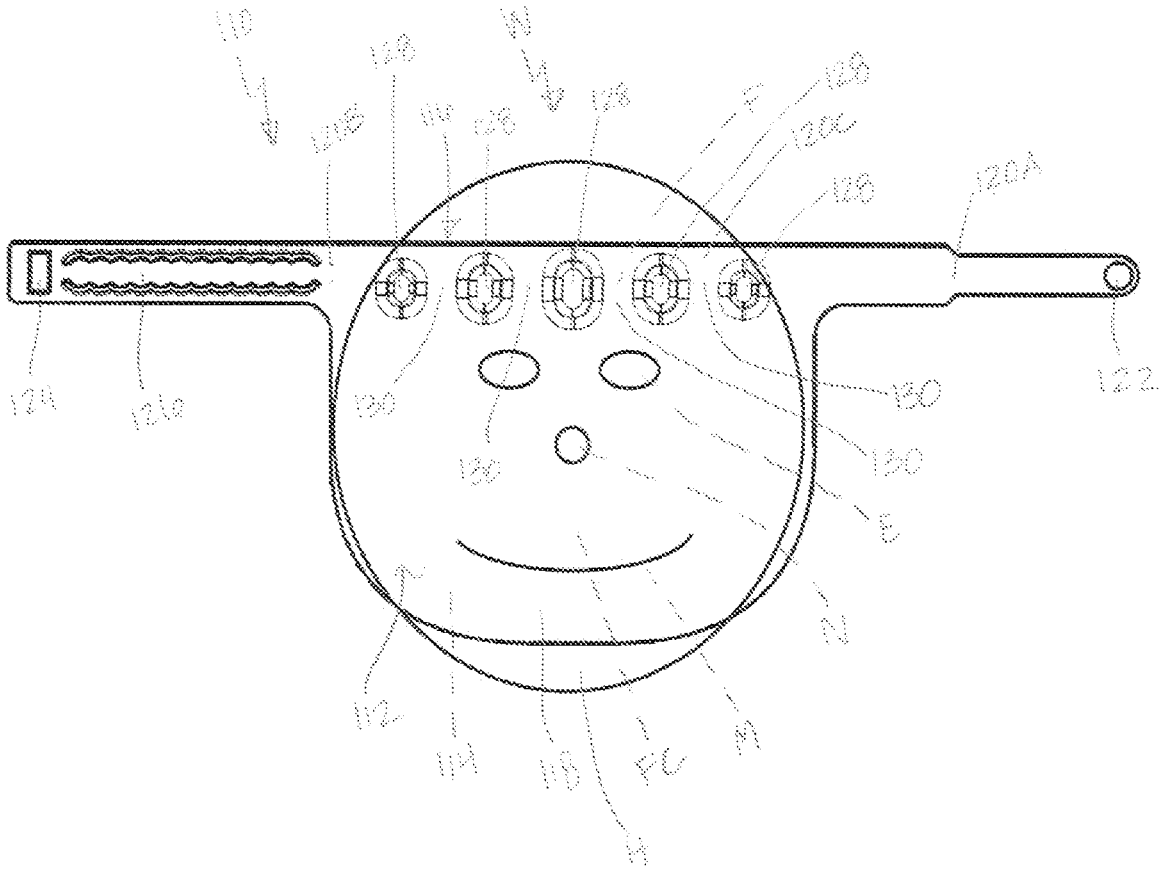
FIG. 3C is a front plan view of the second embodiment of the face shield shown in FIG. 3A positioned over a wearer.

FIG. 3A is a back isometric view of face shield 110. FIG. 3B is a side view of face shield 110 shown in FIG. 3A. FIG. 3C is a front plan view of face shield 110 positioned over wearer W. FIGS. 3A-3C will be discussed together. Face shield 110 includes front surface 112, back surface 114, band portion 116, and shield portion 118. Band portion 116 includes first arm 120A, second arm 120B, and center portion 120C. First arm 120A includes snap stud 122. Second arm 120B includes keeper 124 and snap socket path 126. Center portion 120C includes spacing projections 128 and ventilating spaces 130. Face shield 110 is shown as being transparent in FIG. 3C, which further shows wearer W having head H, forehead F, face FC, eyes E, nose N, and mouth M.

Face shield 110 shown in FIGS. 3A-3C has the same overall structure and design as face shield 10 shown in FIGS. 1A-2B, however face shield 110 includes snap socket path 126 instead of snap sockets 26 on face shield 10. The reference numerals that refer to parts of face shield 110 are incremented by one-hundred compared to the reference numerals that refer to parts of face shield 10 shown in FIGS. 1A-2B.

Snap socket path 126 includes a plurality of snap sockets that abut one another to create snap socket path 126. Snap stud 122 can be releasably engaged in any of the snap sockets along snap socket path 126. This allows for greater flexibility in the sizing of band portion 116 of face shield 110.

Figure 4A:
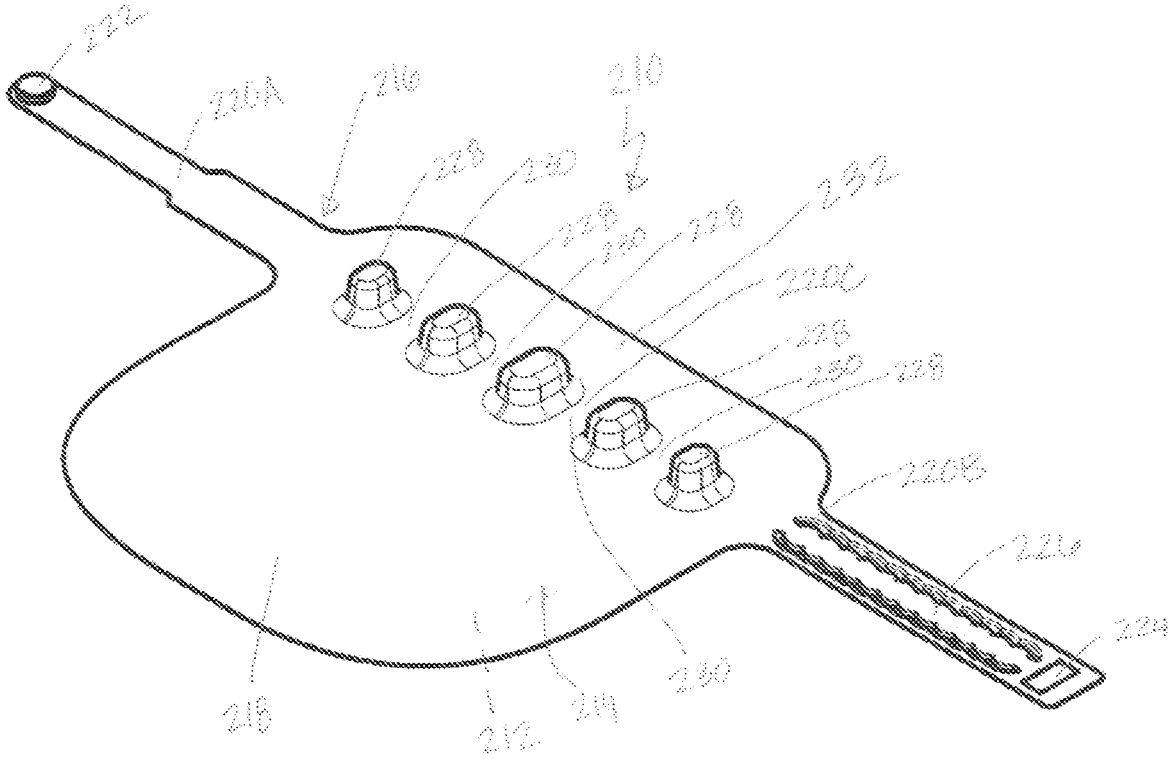
FIG. 4A is a back isometric view of a third embodiment of a face shield.
Figure 4B:
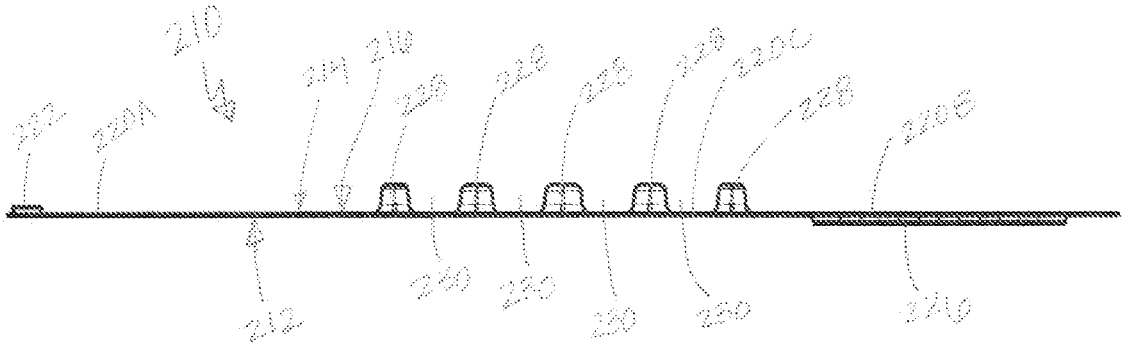
FIG. 4B is a side view of the third embodiment of the face shield shown in FIG. 4A.
Figure 4C:
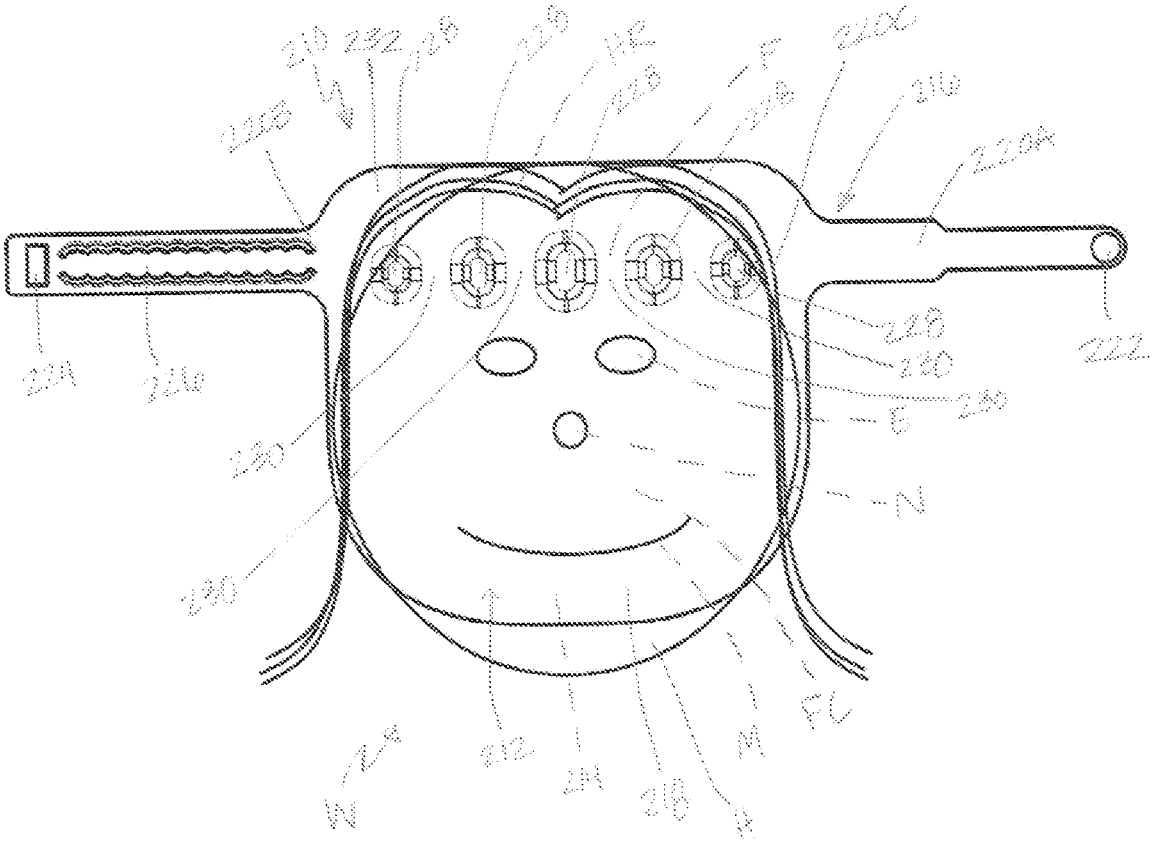
FIG. 4C is a front plan view of the third embodiment of the face shield shown in FIG. 4A positioned over a wearer.

FIG. 4A is a back isometric view of face shield 210. FIG. 4B is a side view of face shield 210 shown in FIG. 4A. FIG. 4C is a front plan view of face shield 210 positioned over wearer W. Face shield 210 includes front surface 212, back surface 214, band portion 216, and shield portion 218. Band portion 216 includes first arm 220A, second arm 220B, and center portion 220C. First arm 220A includes snap stud 222. Second arm 220B includes keeper 224 and snap socket path 226. Center portion 220C includes spacing projections 228 and ventilating spaces 230. Face shield 210 further includes upper portion 232. Face shield 210 is shown as being transparent in FIG. 4C, which further shows wearer W having head H, forehead F, face FC, eyes E, nose N, mouth M, and hair HR.

Face shield 210 shown in FIGS. 4A-4C has the same overall structure and design as face shield 10 shown in FIGS. 1A-2B, however face shield 210 includes snap socket path 226 similar to face shield 110 shown in FIGS. 2A-2B instead of snap sockets 26 on face shield 10. Face shield 210 further includes upper portion 232. The reference numerals that refer to parts of face shield 210 are incremented by two-hundred compared to the reference numerals that refer to parts of face shield 10 shown in FIGS. 1A-2B.

Upper portion 232 extends upwards from center portion 220C of band portion 216. Upper portion 232 is integrally formed with center portion 220C of band portion 216, and thus with face shield 210. As shown in FIG. 4C, upper portion 232 extends upwards from center portion 220C and covers forehead F and hair HR on a top of head H of wearer 10. This provides wearer W with further protection against hazards.

Figure 5A:
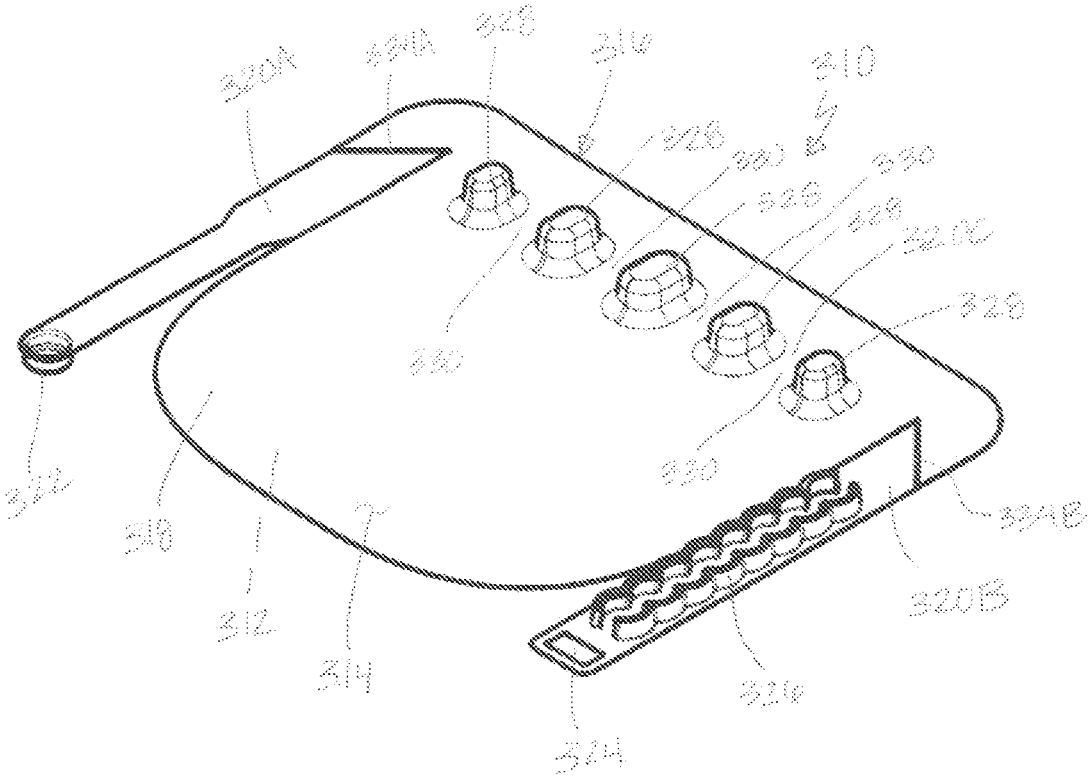
FIG. 5A is a back isometric view of a fourth embodiment of a face shield in a first position.
Figure 5B:
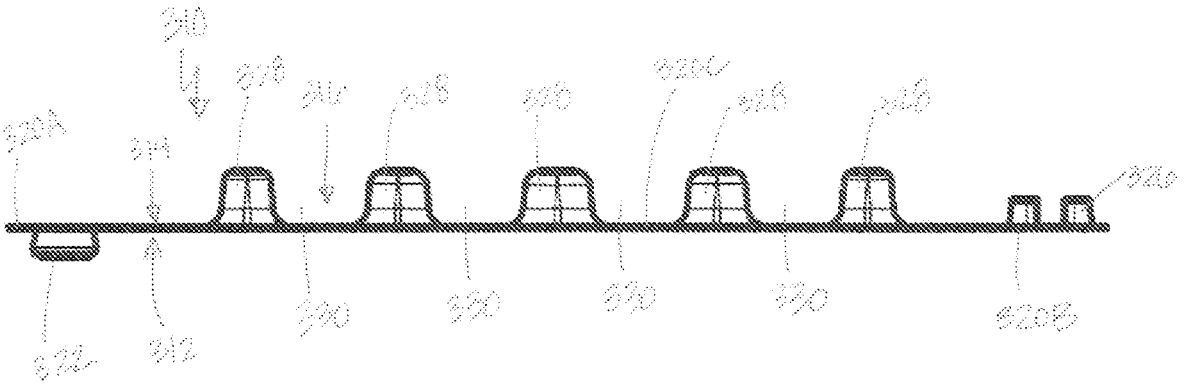
FIG. 5B is a side view of the fourth embodiment of the face shield shown in FIG. 5A in the first position.
Figure 5C:
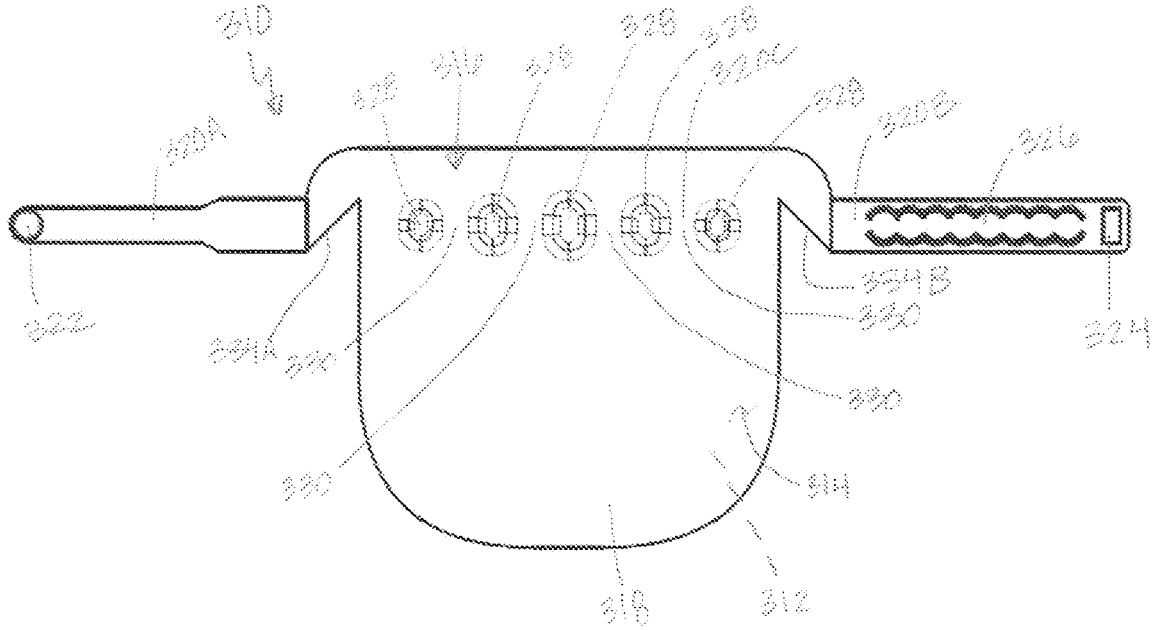
FIG. 5C is a back plan view of the fourth embodiment of the face shield shown in FIG. 5A in a second position.
Figure 5D:
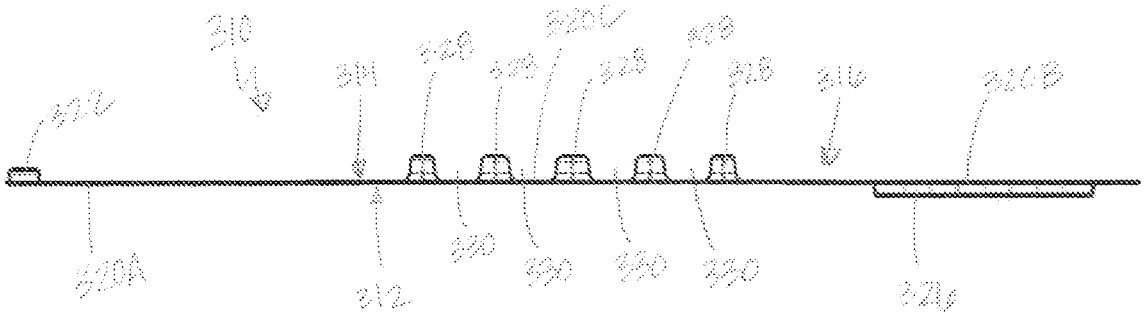
FIG. 5D is a side view of the fourth embodiment of the face shield shown in FIG. 5A in the second position.
Figure 5E:
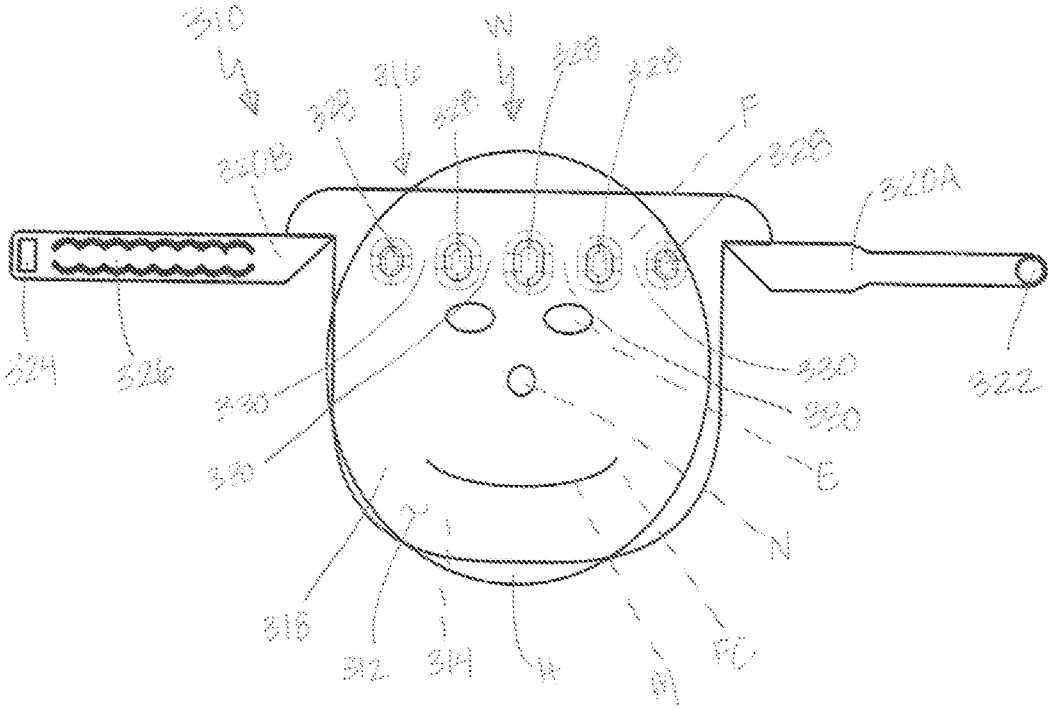
FIG. 5E is a front plan view of the fourth embodiment of the face shield shown in FIG. 5A in the second position positioned over a wearer.

FIG. 5A is a back isometric view face shield 310 in a first position. FIG. 5B is a side view of face shield 310 in the first position. FIG. 5C is a back plan view of face shield 310 in a second position. FIG. 5D is a side view of face shield 310 in the second position. FIG. 5E is a front plan view of face shield 310 in the second position positioned over wearer W. Face shield 310 includes front surface 312, back surface 314, band portion 316, and shield portion 318. Band portion 316 includes first arm 320A, second arm 320B, and center portion 320C. First arm 320A includes snap stud 322. Second arm 320B includes keeper 324 and snap socket path 326. Center portion 320C includes a plurality of spacing projections 328 and a plurality of ventilating spaces 330. Face shield 310 further includes first fold line 334A and second fold line 334B. Face shield 310 is shown as being transparent in FIG. 5E, which further shows wearer W having head H, forehead F, face FC, eyes E, nose N, and mouth M.

Face shield 310 shown in FIGS. 5A-5E has the same overall structure and design as face shield 10 shown in FIGS. 1A-2B, however face shield 310 includes snap socket path 326 similar to face shield 110 shown in FIGS. 2A-2B instead of snap sockets 26 on face shield 10. Face shield 310 also includes first fold line 334A and second fold line 334B. The reference numerals that refer to parts of face shield 310 are incremented by three-hundred compared to the reference numerals that refer to parts of face shield 10 shown in FIGS. 1A-2B.

As shown in FIGS. 5A-5B, when face shield 310 is manufactured, first arm 320A and second arm 320B will be in a first position where they extend along a first side and a second side of shield portion 318. As shown in FIGS. 5C-5D, wearer W can fold first arm 320A along first fold line 334A and second arm 320B along second fold line 334B. First arm 320A and second arm 320B will then be in a second position where they extend outwards from shield portion 318 and center portion 320C. When face shield 310 is in the second position shown in FIGS. 5C-5D, wearer W can wrap first arm 320A and second arm 320B around their head H.

First fold line 334A and second fold line 334B can be formed on face shield 310 during or after the thermoforming process. Manufacturing first arm 320A and second arm 320B in the first position shown in FIGS. 5A-5B reduces material waste during manufacturing and lowers the manufacturing cost. Further, face shield 310 is more compact in the first position shown in FIGS. 5A-5B, which reduces shipping costs. Additionally, it takes minimal effort for wearer W to fold first arm 320A along first fold line 334A and second arm 320B along second fold line 334B, allowing face shield 310 to still be used with minimal time and assembly.

Figure 6A:
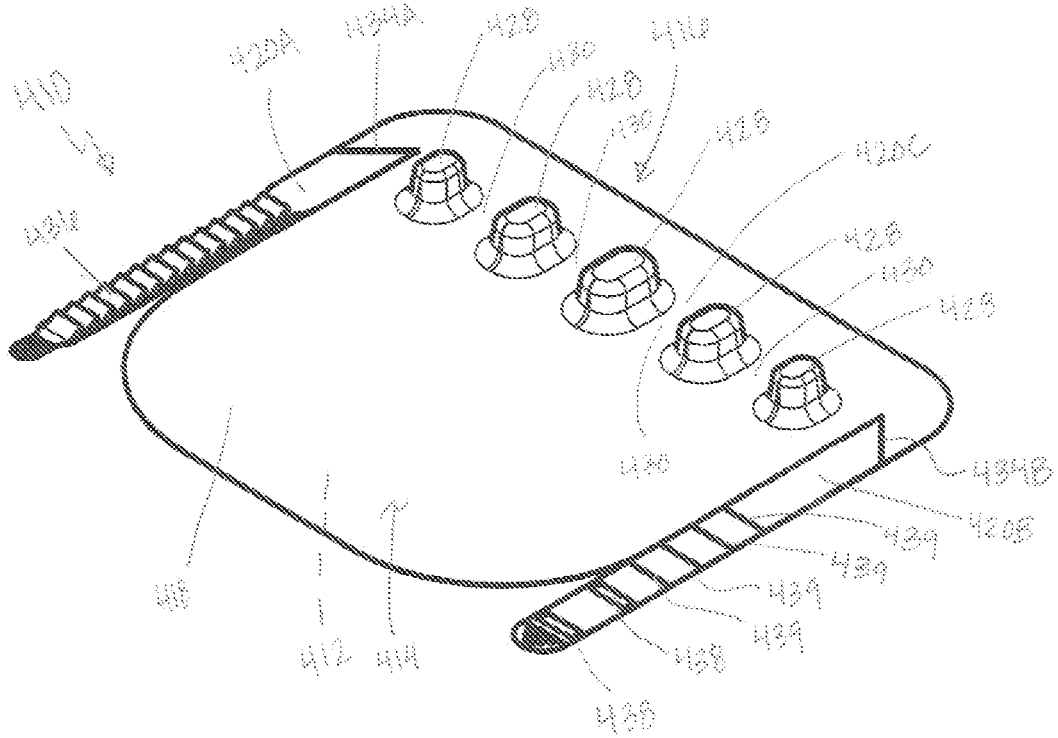
FIG. 6A is a back isometric view of a fifth embodiment of a face shield in a first position.
Figure 6B:
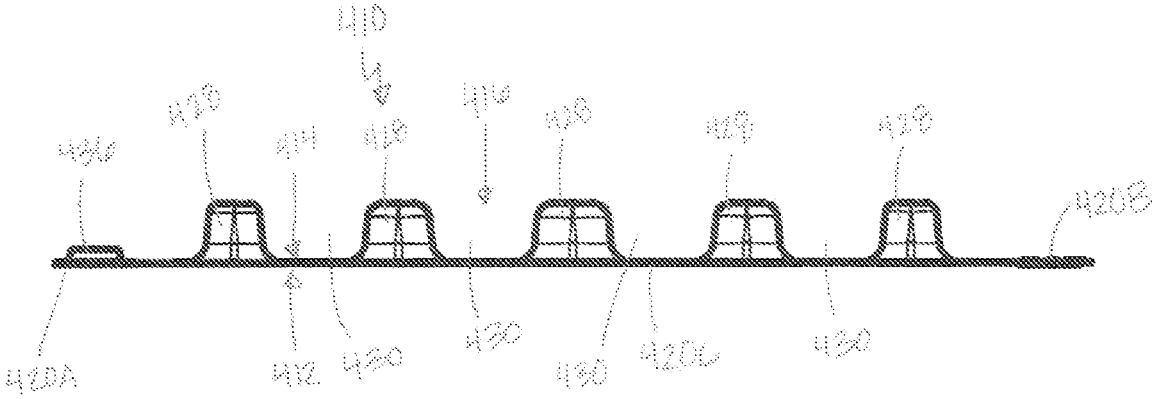
FIG. 6B is a side view of the fifth embodiment of the face shield shown in FIG. 6A in the first position.
Figure 6C:
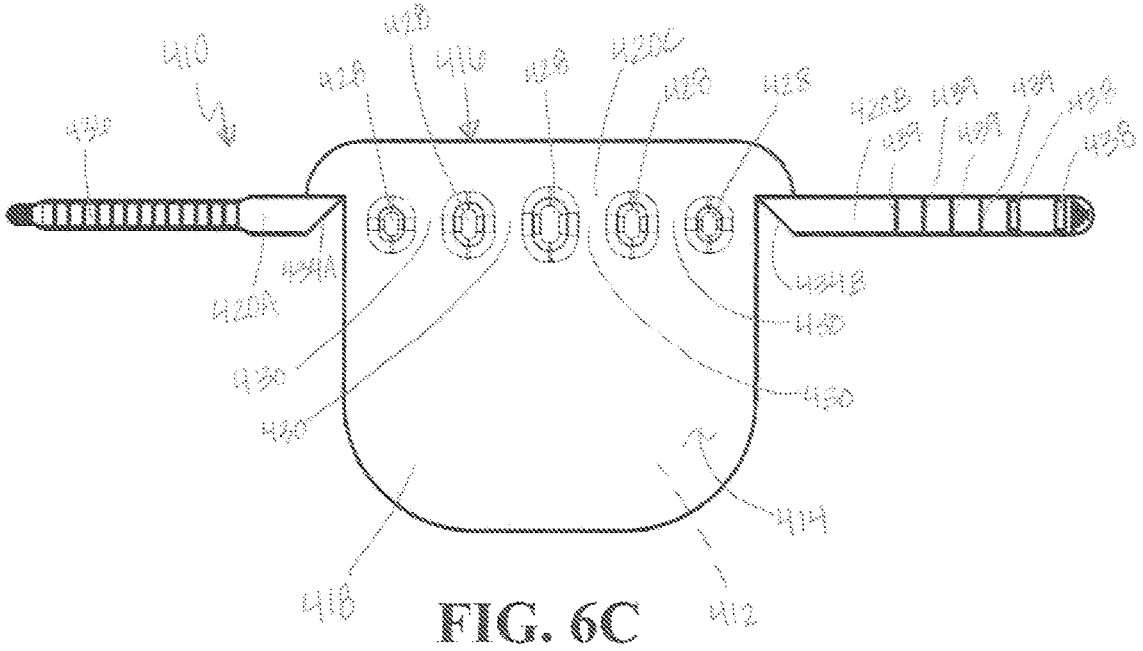
FIG. 6C is a back plan view of the fifth embodiment of the face shield shown in FIG. 6A in a second position.
Figure 6D:
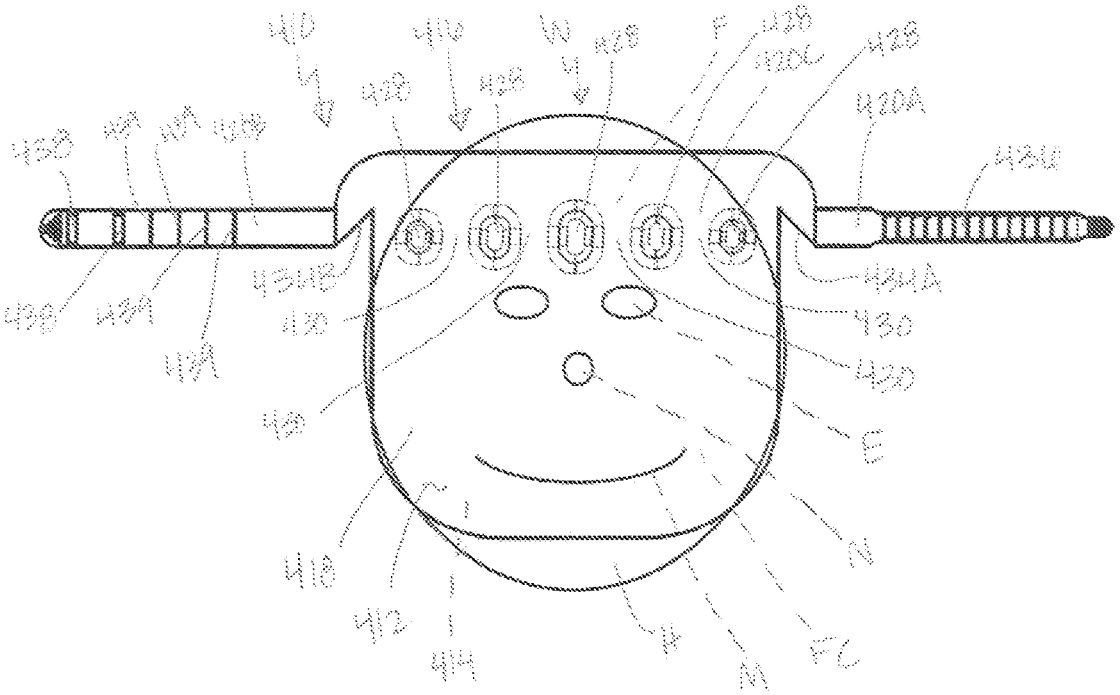
FIG. 6D is a front plan view of the fifth embodiment of the face shield shown in FIG. 6A in the second position positioned over a wearer.

FIG. 6A is a back isometric view of face shield 410 in a first position. FIG. 6B is a side view of face shield 410 in the first position. FIG. 6C is a back plan view of face shield 410 in a second position. FIG. 6D is a front plan view of face shield 410 the second position positioned over wearer W. Face shield 410 includes front surface 412, back surface 414, band portion 416, and shield portion 418. Band portion 416 includes first arm 420A, second arm 420B, and center portion 420C. Center portion 420C includes a plurality of spacing projections 428 and a plurality of ventilating spaces 430. Face shield 410 further includes first fold line 434A and second fold line 434B. First arm 420A includes ridges 436. Second arm 420B includes slots 438 and cuts 439. Face shield 410 is shown as being transparent in FIG. 6D, which further shows wearer W having head H, forehead F, face FC, eyes E, nose N, and mouth M.

Face shield 410 shown in FIGS. 6A-6D has the same overall structure and design as face shield 10 shown in FIGS. 1A-2B, however face shield 410 includes ridges 436, slots 438, and cuts 439 instead of snap stud 22, keeper 24, and snap sockets 26 on face shield 10. Face shield 410 also includes first fold line 434A and second fold line 434B. The reference numerals that refer to parts of face shield 410 are incremented by four-hundred compared to the reference numerals that refer to parts of face shield 10 shown in FIGS. 1A-2B.

As shown in FIGS. 6A-6B, when face shield 410 is manufactured, first arm 420A and second arm 420B will be in a first position where they extend along a first side and a second side of shield portion 418. As shown in FIG. 6C, wearer W can fold first arm 420A along first fold line 434A and second arm 420B along second fold line 434B. First arm 420A and second arm 420B will then be in a second position where they extend outwards from shield portion 418 and center portion 420C. When face shield 410 is in the second position shown in FIG. 6C, wearer W can wrap first arm 420A and second arm 420B around their head H.

First fold line 434A and second fold line 434B can be formed on face shield 410 during or after the thermoforming process. Manufacturing first arm 420A and second arm 420B in the first position shown in FIGS. 6A-6B reduces material waste during manufacturing and lowers the manufacturing cost. Further, face shield 410 is more compact in the first position shown in FIGS. 6A-6B, which reduces shipping costs. Additionally, it takes minimal effort for wearer W to fold first arm 420A along first fold line 434A and second arm 420B along second fold line 434B, allowing face shield 410 to still be used with minimal time and assembly.

Face shield 410 further includes ridges 436 on first arm 420A, and slots 438 and cuts 439 on second arm 420B. Ridges 436 includes a plurality of abutting ridges that extend along first arm 420A from an outer end to an inner end. Ridges 436 are shaped to have each have a slanted face and a catching face that is perpendicular to first arm 420A. Slots 438 are positioned near an outer end of second arm 420B. In the embodiment shown in FIGS. 6A-6D, face shield 410 includes two slots 438, but face shield 410 can include a single slot or three or more slots in alternate embodiments. Cuts 439 are positioned on second arm 420B between slots 438 and an inner end of second arm 420B. In the embodiment shown in FIGS. 6A-6D, face shield 410 includes four cuts 439, but face shield 610 can include any number of cuts, including no cuts, in alternate embodiments.

In use, first arm 420A can be positioned through one of slots 438. First arm 420A can be pulled through one of slots 438 until band portion 416 is tightly fit around head H of wearer W. First arm 420A can be easily pulled through one of slots 438, as the slanted faces of ridges 436 slide along the edge of one of slots 438. Once band portion 416 is tightly fit around head H of wearer W, the catching face of one of ridges 436 will catch the edge of one of slots 438 to hold first arm 420A in position in one of slots 438. As such, ridges 436 and slots 438 provide a secure and easy way to tighten band portion 416 around head H of wearer W. Cuts 439 are included on second arm 420B to hold the outer end of first arm 420A against second arm 420B, if desired. Depending on the size of head H of wearer W, a varying length of first arm 420A will be pulled through one of slots 438. Wearer W can use one of cuts 439 to tuck the outer end of first arm 420A into to secure first arm 420A against second arm 420B.

Ridges 436, slots 438, and cuts 439 allow for great flexibility in the sizing of band portion 416 of face shield 410. This allows face shield 410 to be snuggly and comfortably fit on wearers ranging from adults with larger heads to children with smaller heads.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A face shield comprising:

a front surface opposite of a back surface;

a shield portion;

a band portion extending from a top side of the shield portion, the band portion comprising:

a center portion extending from the top end of the shield portion;

a first arm extending substantially parallel to a first side of the shield portion, wherein the first arm is configured to move between a first and a second position; and a second arm extending substantially parallel to a second side of the shield portion, wherein the second arm is configured to move between the first and the second position;

wherein in the first position, the first arm extends substantially parallel to the first side of the shield portion and the second arm extends substantially parallel to the second side of the shield portion, and wherein in the second position, the first arm and the second arm extend outward from the center portion; and a plurality of spacing projections extending outward from the back surface of the face shield that are configured to be positioned against a forehead of a wearer.

2. The face shield of claim 1, wherein the shield portion is configured to cover and be positioned adjacent to a face of the wearer.

3. The face shield of claim 1, wherein the plurality of spacing projections are positioned on the center portion.

4. The face shield of claim 1, and further comprising:

a snap stud positioned on and protruding outward from the back surface of the first arm; and a snap socket positioned on and protruding outward from the front surface of the second arm;

wherein the snap stud is configured to be releasably engaged in the snap socket.

5. The face shield of claim 4, and further comprising:

a plurality of snap sockets positioned on and protruding outward from the front surface of the second arm.

6. The face shield of claim 1, and further comprising:

a snap stud positioned on and protruding outward from the back surface of the first arm; and a snap socket path positioned on and protruding outward from the front surface of the second arm;

wherein the snap stud is configured to be releasably engaged in the snap socket path.

7. The face shield of claim 6, wherein the snap socket path includes a plurality of snap sockets that abut one another, and wherein the snap stud is configured to be releasably engaged in one of the plurality of snap sockets of the snap socket path.

8. The face shield of claim 1, and further comprising:

a keeper positioned on the second arm, wherein the first arm is configured to extend through the keeper when the face shield is positioned around a head of the wearer.

9. The face shield of claim 1, and further comprising:

a plurality of ridges extending along the first arm; and a slot in the second arm;

wherein the first arm is configured to be pulled through the slot in the second arm so that one of the plurality of ridges will catch in the slot.

10. The face shield of claim 9, and further comprising:

a cut in the second arm, wherein an outer end of the first arm is configured to be secured in the cut in the second arm.

11. The face shield of claim 1, and further comprising:

a first fold line on the first arm, wherein the first arm is configured to be folded along the first fold line to move between the first position and the second position; and a second fold line on the second arm, wherein the second arm is configured to be folded along the second fold line to move between the first position and the second position.

12. The face shield of claim 1, wherein the plurality of spacing projections are configured to space the shield portion from the face of the wearer.

13. The face shield of claim 1, wherein the plurality of spacing projections are positioned on the band portion.

14. The face shield of claim 1, wherein each of the plurality of spacing protrusions comprises:

a contact portion that is configured to be positioned against the forehead of the wearer;

a sidewall;

a first tapered portion extending between the contact portion and the sidewall; and a second tapered portion extending between the sidewall and the face shield.

15. The face shield of claim 1, wherein each of the plurality of spacing protrusions is shaped like an oval.

16. The face shield of claim 1, wherein the plurality of spacing protrusions includes a center spacing protrusion, a first side spacing protrusion, and a second side spacing protrusion, and wherein the center spacing protrusion is larger than the first side spacing protrusion and the second side spacing protrusion.

17. The face shield of claim 1, and further comprising:

a plurality of ventilating spaces, wherein each of the plurality of ventilating spaces is positioned between adjacent spacing protrusions of the plurality of spacing protrusions.

18. The face shield of claim 1, and further comprising:

an upper portion extending from a top side of the band portion, wherein the upper portion is configured to cover a forehead and hair of the wearer.

19. The face shield of claim 1, wherein the face shield is thermoformed from a single piece of material.

* * * * *